US007938178B2

(12) United States Patent
Ringgenberg et al.

(10) Patent No.: US 7,938,178 B2
(45) Date of Patent: May 10, 2011

(54) DISTRIBUTED TEMPERATURE SENSING IN DEEP WATER SUBSEA TREE COMPLETIONS

(75) Inventors: Paul D. Ringgenberg, Frisco, TX (US); John L. Maida, Jr., Houston, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 887 days.

(21) Appl. No.: 11/692,760

(22) Filed: Mar. 28, 2007

(65) Prior Publication Data

US 2008/0073084 A1 Mar. 27, 2008

Related U.S. Application Data

(62) Division of application No. 10/790,908, filed on Mar. 2, 2004, now Pat. No. 7,210,856.

(51) Int. Cl.
*E21B 41/00* (2006.01)
*E21B 29/12* (2006.01)
*G01V 3/00* (2006.01)

(52) U.S. Cl. ..... 166/250.01; 166/336; 166/242.6; 166/66; 340/853.1; 340/853.2; 385/53

(58) Field of Classification Search ..... 166/336, 166/368, 66, 179, 183, 242.1, 242.6, 242.7, 166/250.01; 385/12, 100, 138, 53; 340/853.1, 340/853.2; 367/25; 250/227.14–227.18
See application file for complete search history.

(56) References Cited

U.S. PATENT DOCUMENTS 3,315,160 A * 4/1967 Goodman David M ..... 714/735
4,134,455 A 1/1979 Read
4,375,237 A 3/1983 Churchman
4,421,979 A * 12/1983 Asawa et al. ..... 250/227.16
4,442,893 A 4/1984 Foust
4,483,584 A 11/1984 Gresty
4,534,424 A * 8/1985 Ramsey ..... 175/40
4,580,263 A * 4/1986 Watanabe et al. ..... 714/705
4,624,309 A 11/1986 Schnatzmeyer
4,666,241 A 5/1987 Caron
4,690,212 A 9/1987 Termohlen
4,756,595 A 7/1988 Braun et al.
4,757,859 A 7/1988 Schnatzmeyer
4,824,198 A 4/1989 Anderton
4,825,946 A 5/1989 Schnatzmeyer
4,828,027 A 5/1989 Schnatzmeyer (Continued)

FOREIGN PATENT DOCUMENTS

GB 2318397 4/1998

(Continued)

OTHER PUBLICATIONS

Focal Technologies Corporation, Product Brochure for Model 286, dated Apr. 15, 2003.

(Continued)

*Primary Examiner* — Thomas A Beach

(74) *Attorney, Agent, or Firm* — John W. Wustenberg; Smith IP Services P.C.

(57) ABSTRACT

A deep water subsea tree completion having a distributed temperature sensing system. In a described embodiment, a method of installing an optical fiber in a well includes the steps of: conveying an optical fiber section into the well; and monitoring a light transmission quality of the optical fiber section while the section is being conveyed into the well.

35 Claims, 2 Drawing Sheets

U.S. PATENT DOCUMENTS 4,846,269 A 7/1989 Schnatzmeyer
4,887,883 A 12/1989 Darbut et al.
4,921,438 A 5/1990 Godfrey et al.
5,048,610 A 9/1991 Ross et al.
5,187,366 A * 2/1993 Hopenfeld ..... 250/302
5,243,681 A 9/1993 Bowen et al.
5,251,708 A 10/1993 Perry et al.
5,396,569 A * 3/1995 Yanagawa et al. ..... 385/24
5,435,351 A 7/1995 Head
5,440,665 A 8/1995 Ray et al.
5,505,260 A 4/1996 Andersen et al.
5,577,925 A 11/1996 Schnatzmeyer et al.
5,645,438 A 7/1997 Cairns
5,645,483 A 7/1997 Cushman
5,727,630 A 3/1998 Brammer
5,778,978 A 7/1998 Crow
5,803,167 A 9/1998 Bussear et al.
5,825,963 A 10/1998 Burgett
5,831,156 A 11/1998 Mullins
5,947,198 A 9/1999 McKee et al.
6,006,828 A 12/1999 Kluth et al.
6,017,227 A 1/2000 Cairns et al.
6,062,073 A 5/2000 Patton et al.
6,125,938 A * 10/2000 Garcia-Soule et al. ..... 166/344
6,152,608 A 11/2000 Ghara et al.
6,186,229 B1 2/2001 Martin et al.
6,279,660 B1 * 8/2001 Hay ..... 166/336
6,281,489 B1 8/2001 Tubel et al.
6,302,203 B1 10/2001 Rayssiguier et al.
6,325,146 B1 * 12/2001 Ringgenberg et al. ... 166/250.17
6,332,787 B1 12/2001 Barlow et al.
6,349,770 B1 2/2002 Brooks et al.
6,378,610 B2 4/2002 Rayssiguier et al.
6,439,778 B1 8/2002 Cairns
6,464,405 B2 10/2002 Cairns et al.
6,478,091 B1 11/2002 Gano
6,527,052 B2 3/2003 Ringgenberg et al.
6,527,441 B1 3/2003 Cranch et al.
6,531,694 B2 * 3/2003 Tubel et al. ..... 250/227.14
6,538,779 B1 * 3/2003 Takeshita et al. ..... 398/27
6,568,481 B2 5/2003 Koehler et al.
6,666,274 B2 12/2003 Hughes
6,684,950 B2 2/2004 Patel
6,685,361 B1 2/2004 Rubino et al.
6,718,138 B1 * 4/2004 Sugawara ..... 398/9
6,725,924 B2 * 4/2004 Davidson et al. ..... 166/250.01
6,736,545 B2 5/2004 Cairns et al.
6,758,271 B1 7/2004 Smith
6,758,272 B2 7/2004 Bixenman et al.
6,766,853 B2 7/2004 Laursen et al.
6,776,636 B1 * 8/2004 Cameron et al. ..... 439/191
6,789,621 B2 * 9/2004 Wetzel et al. ..... 166/253.1
6,837,310 B2 1/2005 Martin
6,874,361 B1 4/2005 Meltz et al.
6,933,491 B2 8/2005 Maida et at.
6,951,252 B2 10/2005 Restarick
6,983,796 B2 1/2006 Bayne et al.
7,021,388 B2 * 4/2006 Williams ..... 166/372
7,080,940 B2 7/2006 Gotthold et al.
7,191,832 B2 * 3/2007 Grigsby et al. ..... 166/278
7,228,898 B2 * 6/2007 Grigsby et al. ..... 166/242.6
7,254,999 B2 * 8/2007 Bostick, III ..... 73/152.16
7,641,395 B2 * 1/2010 Ringgenberg et al. ..... 385/53
7,708,078 B2 * 5/2010 Stoesz ..... 166/378
2002/0007970 A1 * 1/2002 Terry et al. ..... 175/92
2002/0014340 A1 2/2002 Johnson
2002/0125008 A1 9/2002 Wetzel et al.
2002/0162666 A1 11/2002 Koehler et al.
2002/0196993 A1 * 12/2002 Schroeder ..... 385/12
2003/0066643 A1 * 4/2003 Ringgenberg et al. ... 166/250.01
2003/0077043 A1 4/2003 Hamm et al.
2003/0081917 A1 * 5/2003 Bussear ..... 385/101
2003/0131990 A1 * 7/2003 Tubel et al. ..... 166/250.01
2003/0141075 A1 7/2003 Bixenman et al.
2003/0192708 A1 10/2003 Koehler et al.
2003/0196820 A1 10/2003 Patel
2003/0213598 A1 11/2003 Hughes
2004/0013391 A1 1/2004 Joseph
2004/0065439 A1 4/2004 Tubel et al.
2004/0067002 A1 * 4/2004 Berg et al. ..... 385/12
2004/0173350 A1 9/2004 Wetzel et al.
2004/0256127 A1 12/2004 Brenner et al.
2004/0256137 A1 12/2004 Bertini et al.
2005/0072564 A1 4/2005 Grigsby et al.
2005/0074196 A1 4/2005 Grigsby et al.
2005/0074210 A1 4/2005 Grigsby et al.
2005/0109518 A1 5/2005 Blacklaw
2005/0232548 A1 10/2005 Ringgenberg
2005/0281511 A1 12/2005 Ringgenberg et al.
2006/0153487 A1 7/2006 McLellan et al.

FOREIGN PATENT DOCUMENTS

WO 8602173 4/1986
WO 03046428 6/2003
WO 05054801 6/2006

OTHER PUBLICATIONS

Halliburton, "X-Line® and R-Line® Landing Nipples and Lock Mandrel; Set and Lock Reliability in Subsurface Flow Control Equipment With a Total Completion Package," dated Mar. 1997.
SPE 84324, "Brunei Field Trial of a Fibre Optic Distributed Temperature Sensor (DTS) System in a 1,000 m Open Hole Horizontal Oil Producer," dated 2003.
SPE 71676, "The Use of Fiber-Optic Distributed Temperature Sensing and Remote Hydraulically Operated Interval Control Vavles for the Management of Water Production in the Douglas Field," dated 2001.
PES, "Model Fo Fibre Optic Orientating Disconnect Head," dated Oct. 23, 2000.
"Pioneering Fibre Optic Completion Installation in the Mahogany Field, Offshore Trinidad," undated.
Weatherford, "Intelligent Well Briefing," dated May 14, 2003.
Ocean Design, Inc., "Ocean Design Introduces New I-CONN Product Line," dated Jul. 22, 2002.
Seacon, "Microstar, 4-Channel, Wet-Mate, Optical Connector," undated.
Production Optimization,"Intelligent Completions," undated.
W Magazine, "Intelligent Well Completion, the Next Steps," dated Sep. 2002.
Ocean Design, "Underwater Mateable Connectors: Enabling Technology and the Next Step in Performance for Navy and Telecom Applications," Presented at Underwater Intervention Conference, 2002.
OTC 13235, "Extending Tieback Distances: Wet-Mate Connectors, Enabling Technologies for Critical Systems Developments," dated 2001.
Tronic Ltd., "Firefly Project," undated.
Tronic Ltd., "Tronic Fibre Optic Wellhead Feedthrough Connectors," undated.
Sea Technology, "Hybrid Wet-Mate Connectors: Writing the Next Chapter'," dated Jul. 1997.
Journal of Petroleum Technology, "Development of HP/HT Fiber-Optic Connectors for Subsea Intelligent Wells," dated Aug. 2003.
OTC 15323, "The Development and Application of HT/HP Fiber-Optic Connectors for Use on Subsea Intelligent Wells," dated 2003.
Sea Technology, "Optical Fiber and Connectors: Critical for Future Subsea Systems," undated.
Underwater Magazine, "Underwater Mateable Connectors in the Military and Telecom Sectors," dated Sep./Oct. 2002.
World Oil, "World'S First Multiple Fiber-Optic Intelligent Well," dated Mar. 2003.
Intelligent Wells, "Oil Field Applications of Hydroptics Technology," dated Oct. 2002.
Sea Technology, "The Ruggedization of Hybrid Wet-Mate Connectors," dated Jul. 2000.
Intelligent Wells, "Optical Fiber Technology," dated Oct. 2002.
Seacon Advanced Products Data Sheets, pp. 22-1 through 22-20.
Ocean Design, Inc., "l-CONN; Wet-Mateable Optical Connector," dated 2000.
Ocean Design, Inc., "Hybrid Wet-Mate," dated 2000.

Ocean Design, Inc., "NRH Connector," undated.
Seacon, "Fiber Optic Connectors," undated.
The Expo Group, "Tronic Fibre Optic Wellhead Feedthrough Connectors," undated.
Norfolk Wire & Electronics, "Optical Fiber Splice Protectors—FSP," dated 2003.
Halliburton presentation entitled, "Greater Plutonio Completions Workshop," dated Mar. 12, 2003.
Halliburton presentation entitled, "DTS Conceptual Completions," Dec. 3, 2002.
Otis Engineering drawing number 41UP58701 dated May 4, 1993.
Halliburton Energy Services drawing No. 42 00 210 dated Apr. 7, 2001.
Office Action issued Nov. 24, 2008, U.S. Appl. No. 10/873,849, 13 pages.
Office Action for U.S. Appl. No. 10/680,063 dated Jun. 11, 2004.
Office Action for U.S. Appl. No. 101680,053 dated Nov. 8, 2004.
Office Action for U.S. Appl. No. 10/680,625 dated Jan. 26, 2005.
Office Action for U.S. Appl. No. 10/680,053 dated Mar. 8, 2005.
Office Action for U.S. Appl. No. 10/680,053 dated Jul. 6, 2005.
Office Action for U.S. Appl. No. 10/680,440 dated Jul. 6, 2005.
Office Action for U.S. Appl. No. 10/680,625 dated Jun. 27, 2005.
Office Action for U.S. Appl.l No. 10/680,053 dated Oct. 21, 2005.
Office Action for U.S. Appl. No. 10/828,085 dated Mar. 22, 2006.
Office Action for U.S. Appl. No. 10/680,053 dated Mar. 10, 2006.
Office Action for U.S. Appl. No. 10/680,440 dated Jan. 13, 2006.
Office Action for U.S. Appl. No. 10/680,625 dated Mar. 9, 2006.
Office Action for U.S. Appl. No. 11/038,369 dated Feb. 14, 2006.
Office Action for U.S Appl. No. 10/873,849 dated May 5, 2006.
Office Action for U.S. Appl. No. 10/680,440 dated Jul. 5, 2006.
Office Action for U.S. Appl. No. 11/038,369 dated Jul. 11, 2006.
Office Action for U.S. Appl. No. 10/790,908 dated Mar. 14, 2006.
Office Action for U.S. Appl. No. 10/790,908 dated Aug. 24, 2006.
International Search Report for PCT/US04/01857.
Search Report for United Kingdom application No. GB 0507890.2.
Search Report for PCT/US04/01856.
Search Report for PCT/US04/01863.
Search Report for PCT/USO4/01863.
Written Opinion for PCT/US2004/001863.
Written Opinion for PCT/US2004/001856.
Written Opinion for PCT/US2004/001857.
Office Action issued Dec. 17, 2010, for U.S. Appl. No. 12/633,333, 32 pages.

* cited by examiner

DISTRIBUTED TEMPERATURE SENSING IN DEEP WATER SUBSEA TREE COMPLETIONS

CROSS-REFERENCE TO RELATED APPLICATION

This application is a division of prior application Ser. No. 10/790,908 filed on Mar. 2, 2004 now U.S. Pat. No. 7,210,856. The entire disclosure of this prior application is incorporated herein by this reference.

BACKGROUND

The present invention relates generally to operations performed and equipment utilized in conjunction with subterranean wells and, in an embodiment described herein, more particularly provides methods and apparatus for distributed temperature sensing in deep water subsea tree completions.

Distributed temperature sensing (DTS) is a well known method of using an optical fiber to sense temperature along a wellbore. For example, an optical fiber positioned in a section of the wellbore which intersects a producing formation or zone can be used in determining where, how much and what fluids are being produced from the zone along the wellbore.

Installation of DTS systems in deep water subsea tree completions could be made less risky and, therefore more profitable, if a fault in a light path of the optical fiber could be identified prior to final installation of the optical fiber in the well. This would enable the fault to be remedied before the riser is removed and the tree is installed. Presently, faults in the optical fiber light path are discovered after the tree is installed, at which time it is very difficult, expensive and sometimes cost-prohibitive, to troubleshoot and repair the faults.

For these reasons and others, it may be seen that it would be beneficial to provide improved methods and apparatus for installation of distributed temperature sensing systems in deep water subsea tree completions. These methods and apparatus will find use in other applications, and in achieving other benefits, as well.

SUMMARY

In carrying out the principles of the present invention, in accordance with an embodiment thereof, an optical fiber installation system and method are provided which decrease the risks associated with distributed temperature sensing in deep water subsea tree completions. The system and method enable a light transmission quality of an optical fiber installation to be monitored while the optical fiber is being installed, thereby permitting faults to be detected quickly.

In one aspect of the invention, a method of installing an optical fiber in a well is provided. The method includes the steps of: conveying an optical fiber section into the well; and monitoring a light transmission quality of the optical fiber section while the section is being conveyed into the well.

In another aspect of the invention, a method of installing an optical fiber in a well includes the steps of: conveying an assembly at least partially into the well with an optical fiber section attached to the assembly, the assembly being conveyed on another assembly; monitoring a light transmission quality of the optical fiber section during the conveying step by transmitting light through the optical fiber section; and then disconnecting the assemblies.

In yet another aspect of the invention, an optical fiber well installation system is provided. The system includes a first assembly conveyed at least partially into the well by a second assembly. An optical connector is attached to each of the first and second assemblies. The optical connectors are connected in order to transmit light through the connected optical connectors between a first optical fiber section attached to the first assembly and a second optical fiber section attached to the second assembly. A light transmitting quality monitor may be connected to the second optical fiber section while the second assembly conveys the first assembly into the well.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
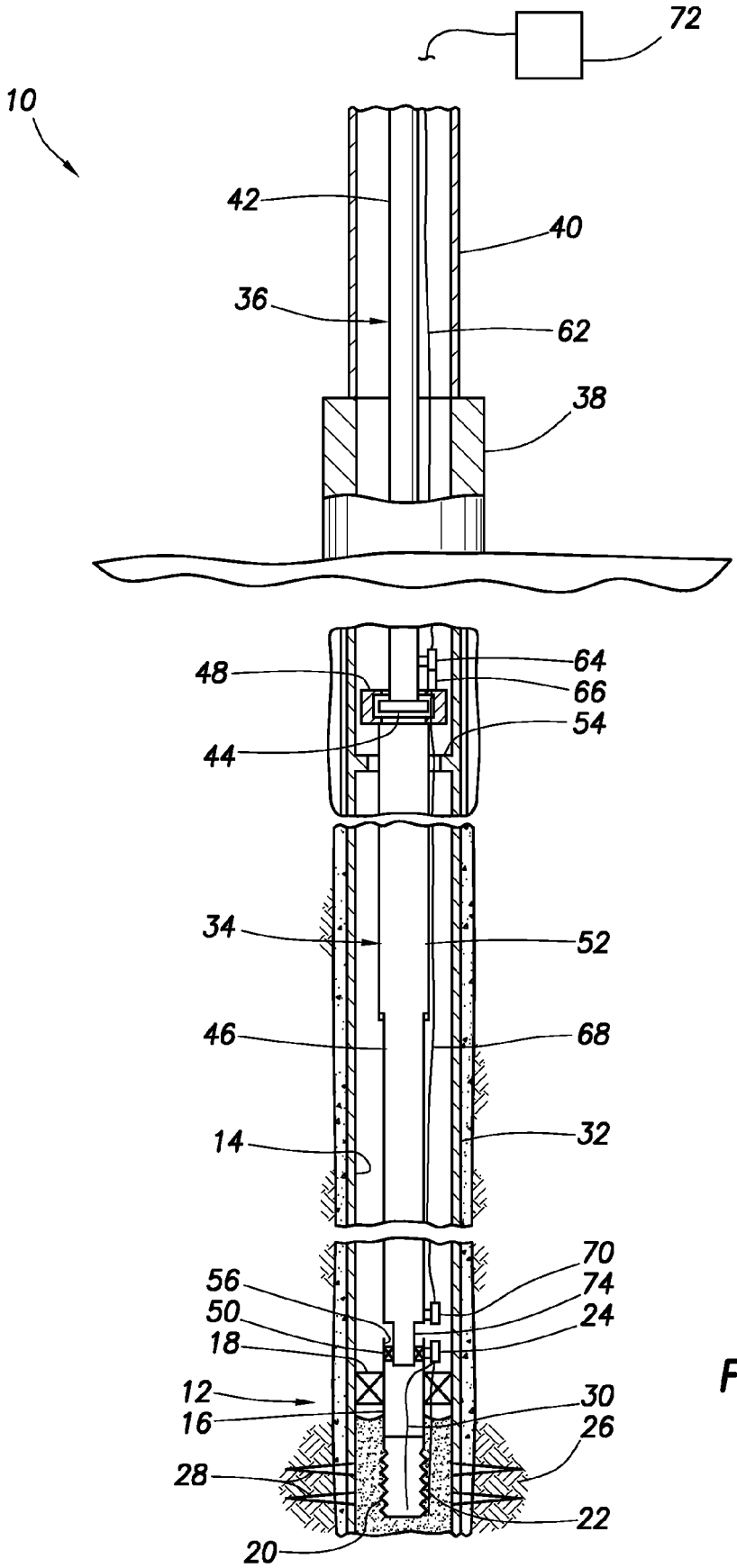
FIG. 1 is a schematic partially cross-sectional view of an optical fiber installation system embodying principles of the present invention.

Representatively illustrated in FIG. 1 is an optical fiber installation system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the system 10 and associated method, a completion assembly 12 is installed in a wellbore 14. The completion assembly 12 may be gravel packed in the wellbore 14, in which case the assembly may include a tubular completion string 16 with a well screen 20 suspended below a packer 18. However, it is to be clearly understood that other types of assemblies and other types of completions may be used in keeping with the principles of the invention.

The assembly 12 further includes a section of optical fiber 22 extending downwardly from an optical connector 24 attached at an upper end of the assembly, through the packer 18, and exterior to the screen 20 through a portion of the wellbore 14 which intersects a formation or zone 26. The section 22 could instead, or in addition, be positioned internal to the screen 20, as depicted for section 30, which extends downwardly from the connector 24 and into the interior of the string 16. The section 22 could also, or alternatively, be positioned external to a casing string 32 lining the wellbore 14, or could be otherwise positioned, without departing from the principles of the invention.

The zone 26 is in communication with the intersecting portion of the wellbore 14 via perforations 28. Other means could be provided for communicating between the zone 26 and wellbore 14, for example, the portion of the wellbore intersecting the zone could be completed open hole, etc.

The section 22 is used in the system 10 for distributed temperature sensing in the wellbore 14. For example, the section 22 may be used to determine the temperature of fluid flowing between the zone 26 and the wellbore 14 in the portion of the wellbore intersecting the zone. The temperature of the fluid may be determined at distributed locations along the intersection between the wellbore 14 and the zone 26, in order to determine where, how much and what fluids are being produced from, or injected into, the zone along the wellbore.

A production tubing assembly 34 is conveyed into the wellbore 14 by use of a work string assembly 36 to suspend the production tubing assembly from a rig (not shown) positioned above a subsea wellhead 38. The production tubing assembly 34 is conveyed by the work string assembly 36 through a riser 40 connecting the rig to the wellhead 38, through the wellhead, and into the wellbore 14. The work string assembly 36 includes a tubular work string 42 having a releasable connection 44 at a lower end.

The production tubing assembly 34 includes a production tubing string 46 having an anchor 48 at an upper end, a seal 50 at a lower end, and a telescoping travel or extension joint 52 between the ends. As schematically depicted in FIG. 1, the anchor 48 is a tubing hanger which engages a shoulder 54 to secure the tubing string 46 in the wellbore 14. The releasable connection 44 is a hanger running tool which, for example, uses a releasable latch to disconnect the work string 42 from the tubing string 46 after the tubing hanger 48 has been "set" by engaging the shoulder 54.

Other types of anchors and other means of setting anchors may be used in keeping with the principles of the invention. For example, the anchor could include slips which grip the wellbore 14 to set the anchor, the anchor could include a latch which engages a corresponding profile, etc.

Figure 2:
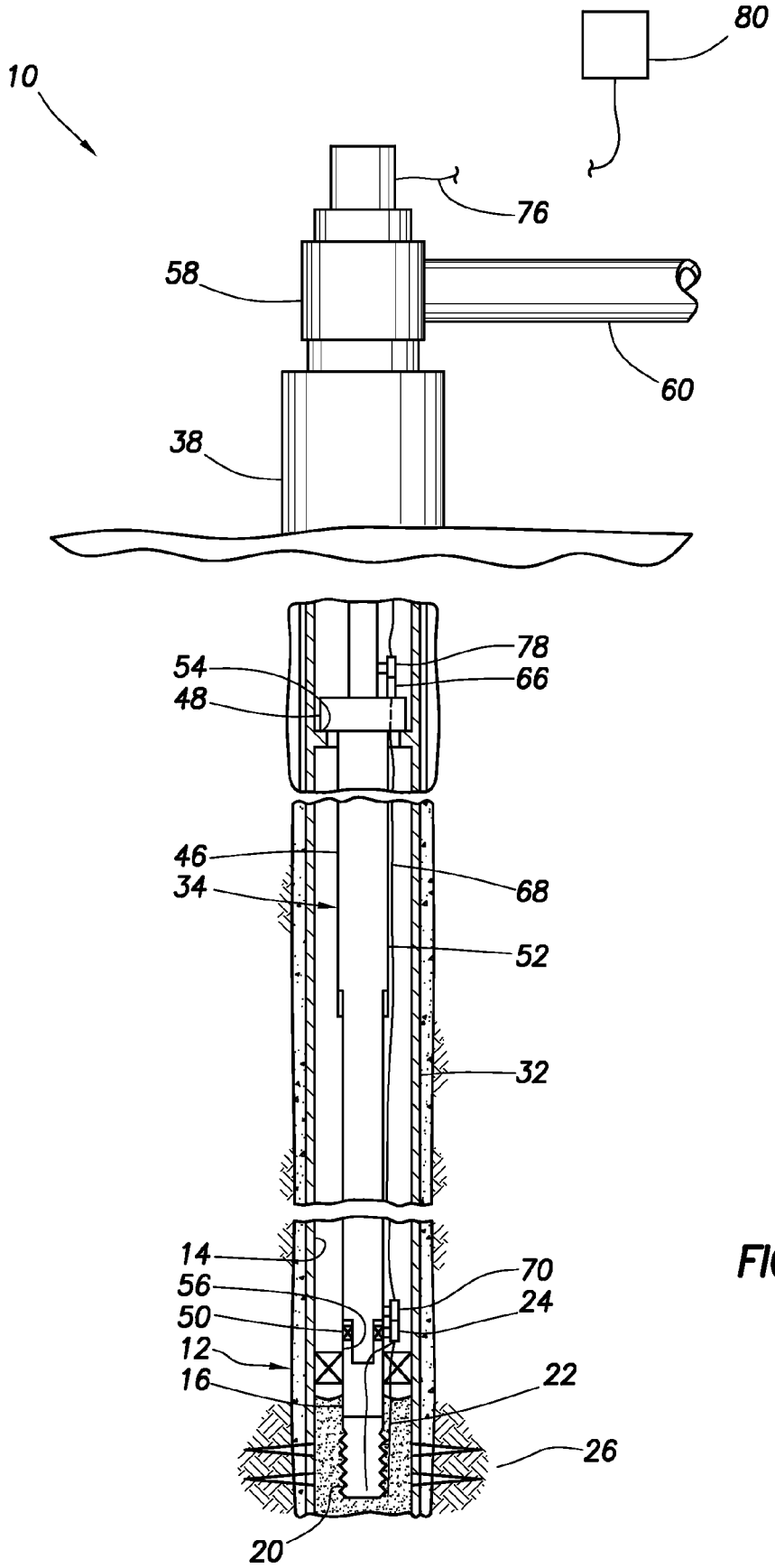
FIG. 2 is a schematic partially cross-sectional view of the system of FIG. 1, in which additional steps of an optical fiber installation method have been performed.

The travel joint 52 permits the seal 50 to engage a seal bore 56 at an upper end of the completion string 16 prior to the anchor 48 engaging the shoulder 54. After the seal 50 is received in the seal bore 56, the travel joint 52 allows the tubing string 46 to axially compress somewhat as the anchor 48 continues displacing downwardly to engage the shoulder 54. This configuration is depicted in FIG. 2, wherein it may be seen that the seal 50 is sealed in the seal bore 56, and the anchor 48 is engaged with the shoulder 54.

When the work string 42 has been disconnected from the tubing string 46, the work string is retrieved from the well. The riser 40 is removed, and a tree 58 is installed on the wellhead 38 to connect the well to a pipeline 60. Note that, if a fault is discovered in the system 10 after the tree 58 is installed, it will be very difficult, time-consuming and, therefore, expensive to troubleshoot and repair the system.

However, in a very beneficial feature of the system 10, faults in the system can be detected during installation when the faults are far easier to troubleshoot and repair. As depicted in FIG. 1, the work string 42 has a section of optical fiber 62 attached thereto. The optical fiber section 62 is coupled to an optical connector 64 at the lower end of the work string 42.

The optical connector 64 is connected to another optical connector 66 at an upper end of the production tubing string 46. Preferably, the connector 66 is positioned above the anchor 48, for convenient connection to the connector 64, and for reasons that are described more fully below. Another optical fiber section 68 is coupled to, and extends between, the connector 66 and another optical connector 70 at a lower end of the tubing string 46.

As the tubing string 46 is conveyed into the wellbore 14 by the work string 42, the upper optical fiber section 62 is optically connected to the section 68 via the connected connectors 64, 66. A light transmitting quality (such as an optical signal transmitting capability, or optical signal loss) of the sections 62, 68 and/or connectors 64, 66 may be monitored by connecting a monitor 72 to the section 62 and transmitting light from the monitor, through the section 62, through the connectors 64, 66, and into the section 68. For example, the monitor 72 may include a light transmitter (such as a laser) for transmitting light into the section 62, an electro-optical converter (such as a photodiode) for receiving light reflected back to the monitor and converting the light into electrical signals, and a display (such as a video display or a printer) for observing measurements of the light transmitting quality indicated by the signals.

If there is a fault in the sections 62, 68 or connectors 64, 66, the monitor 72 can detect the fault before or after the anchor 48 is set, and preferably before the work string 42 is disconnected from the tubing string 46. Of course, it would be very beneficial to detect a fault before the anchor 48 is set, since the tubing string 46 could fairly easily be retrieved from the well for repair at that point. It would also be beneficial to use the monitor 72 to verify the light transmitting quality of the sections 62, 68 and connectors 64, 66 after the anchor 48 is set, for example, to check for faults which may have occurred due to the anchor setting process, or due to other causes. Furthermore, it is desirable to use the monitor 72 to measure the light transmitting quality of the system 10 prior to disconnecting the work string 42 from the tubing string 46, and retrieving the work string from the well.

The monitor 72 may also be used to measure the light transmitting quality of the optical fiber section 22 after the connector 70 has been connected to the connector 24. This connection between the connectors 24, 70 is made when the tubing string 46 is conveyed into the wellbore 14 and the lower end of the tubing string engages the upper end of the completion string 16. This engagement connects the connectors 24, 70 and optically connects the sections 68, 22. For example, a rotationally orienting latch 74 may be used at the lower end of the tubing string 46 to align the connectors 24, 70 when the tubing string engages the completion string 16.

By monitoring the light transmitting quality of the connectors 24, 70 using the monitor 72, the optical connection between the sections 68, 22 may be verified before the anchor 48 is set. If the light transmitting quality of the connection between the connectors 24, 70 is poor, indicating that the connectors may not be fully engaged, or that debris may be hindering light transmission between the connectors, etc., then the connectors 24, 70 may be repeatedly disengaged by raising the tubing string 46, and then re-engaged by lowering the tubing string, until a good light transmitting quality through the connectors is achieved.

Of course, in this process a fault may be detected in another part of the system 10. For example, a fault could be detected in the section 22 while the light transmitting quality of the connectors 24, 70 is being monitored. Thus, it may be seen that the light transmitting quality of any element of the system 10 may be monitored while the light transmitting quality of any other element, or combination of elements, is monitored at the same time.

After the light transmitting quality of each of the sections 68, 22 and/or connections between the connectors 24, 70 and/or connectors 64, 66 have been verified, the work string 42 is disconnected from the tubing string 46. The disconnection of the work string 42 may be accomplished in any manner, such as by raising the work string, rotating the work string, etc. If the work string 42 is to be rotated, then an optical swivel (not shown) may be used on the work string to permit at least a portion of the work string to rotate relative to the connector 64. A suitable optical swivel is the Model 286 fiber optic rotary joint available from Focal Technologies Corporation of Nova Scotia, Canada.

This disconnection of the work string 42 from the tubing string 46 also disconnects the connectors 64, 66 from each other. The work string 42 is then retrieved from the well. The riser 40 is removed and the tree 58 is installed as depicted in FIG. 2.

The tree 58 has another optical fiber section 76 extending through it between an optical connector 78 and another monitor 80. The monitor 80 may actually be a conventional distributed temperature sensing optical interface, which typically includes a computing system for evaluating optical signals transmitted through an optical fiber in a well. Thus, by connecting the connectors 78, 66, the section 76 is placed in optical communication with the section 22, permitting distributed temperature sensing in the portion of the wellbore 14 intersecting the zone 26. The positioning of the connector 66 above the anchor 48 enables convenient connection between the connectors 78, 66 when the tree 58 is installed.

The monitor 72 may also be a conventional distributed temperature sensing optical interface which is used to monitor the light transmitting quality of the system 10 during installation. The monitor 72 may be the same as the monitor 80, or it may be a different monitor, or different type of monitor.

Note that the connectors 24, 70, 64, 66, 78 are preferably optical connectors of the type known to those skilled in the art as "wet mate" or "wet connect" connectors. These types of connectors are specially designed to permit a connection to be formed between the connectors in a fluid. In the wellbore 14, the connectors 24, 70 are optically connected in fluid, the connectors 64, 66 are initially connected and then are disconnected in fluid, and the connectors 66, 78 are optically connected in fluid.

In a manner similar to that described above in which a light transmitting quality of the sections 62, 68 and/or connectors 64, 66 on the tubing string 46 and work string 42 are monitored during installation of the tubing string, a light transmitting quality of the section 22 and/or 30 and/or connector 24 may be monitored during installation of the completion assembly 12. For example, the completion assembly 12 could be installed using the work string 42 or another string and, during this installation, light could be transmitted through the section 22 and/or 30 and/or connector 24 (and a connector connected to the connector 24, and a optical fiber section on the work string, etc.) to monitor a light transmitting quality of these elements. The work string used to install the completion assembly 12 could be a gravel packing string, and the light transmitting quality of the section 22 and/or 30 and/or connector 24 (and a connector connected to the connector 24, and a optical fiber section on the work string, etc.) could, thus, be monitored during and/or after the gravel packing operation.

Although the monitoring of a light transmitting quality of a specific number of optical fiber sections 22, 30, 62, 68, 76 and associated connectors 24, 64, 66, 70, 78 has been described above, it will be readily appreciated that any number of optical fiber sections and connectors may be used, in keeping with the principles of the invention. For example, the tubing string 34 could be installed in multiple trips into the wellbore 14, in which case additional optical fiber sections and connectors may be used on the separately installed portions of the tubing string, each of which could be monitored during its installation. As another example, formations or zones in addition to the single zone 26 described above could be completed using separate completion assemblies, each of which may have its associated optical fiber section(s) and connector(s), and each of the optical fiber sections and connectors may be monitored during installation. As yet another example, the tubing string 34 and completion assembly 12 could be installed in a single trip into the wellbore 14, in which case there may be no need for the separate optical fiber sections 68 and 22 and/or 30, or connectors 24, 70.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of installing an optical fiber in a well, the method comprising the steps of:

conveying a first optical fiber section into the well, an end of the first optical fiber section being coupled to a first optical connector which is not connected to a mating second optical connector; and monitoring a light transmission quality of the first optical fiber section while the first section is being conveyed into the well.

2. The method of claim 1, further comprising the steps of:

conveying a second optical fiber section into the well prior to conveying the first section into the well; and connecting the first and second sections to each other in the well.

3. The method of claim 2, wherein in the monitoring step, the light transmission quality includes a quality of a connection made between the first and second sections in the connecting step.

4. The method of claim 2, wherein the step of conveying the second section further comprises installing the second section in a portion of a wellbore of the well intersecting a zone in communication with the wellbore.

5. The method of claim 1, wherein the conveying step further comprises conveying the first section into the well attached to a first assembly, the first assembly including an anchor for securing the first assembly in the well.

6. The method of claim 5, wherein the anchor is a tubing hanger which engages a support shoulder in the well to secure the first assembly in the well, and wherein the conveying step further comprises monitoring the light transmission quality of the first section prior to engaging the tubing hanger with the support shoulder.

7. The method of claim 5, wherein the conveying step further comprises extending the first section through the anchor between opposite sides of the anchor.

8. The method of claim 5, wherein the conveying step further comprises coupling the first section to the first optical connector on a first side of the anchor, and coupling the first section to a third optical connector on a second side of the anchor.

9. The method of claim 8, wherein the conveying step further comprises connecting the third optical connector to a fourth optical connector on a second assembly used to convey the first assembly into the well; and wherein the monitoring step further comprises monitoring the light transmission quality of the first section prior to disconnecting the third and fourth optical connectors.

10. The method of claim 9, wherein the conveying step further comprises connecting the first optical connector to the second optical connector coupled to a second optical fiber section installed in the well prior to the first section conveying step; and wherein the monitoring step further comprises monitoring a light transmission quality through the connected first and second optical connectors prior to disconnecting the third and fourth optical connectors.

11. A method of installing an optical fiber in a well, the method comprising the steps of:

conveying a first assembly into the well with a first optical fiber section attached to the first assembly, the first assembly being conveyed on a second assembly;

monitoring a light transmission quality of the first optical fiber section during the conveying step by transmitting light through the first optical fiber section prior to connecting the first assembly to a third assembly downhole; and then disconnecting the first and second assemblies.

12. The method of claim 11, wherein the light transmitting step includes transmitting light between optical connectors attached to each of the first and second assemblies.

13. The method of claim 12, wherein the disconnecting step includes disconnecting the optical connectors.

14. The method of claim 11, further comprising the step of anchoring the first assembly in the well prior to the disconnecting step.

15. The method of claim 14, wherein the monitoring step is performed prior to the anchoring step.

16. The method of claim 14, wherein the monitoring step is performed after the anchoring step.

17. The method of claim 14, wherein the anchoring step further comprises engaging a hanger of the first assembly.

18. The method of claim 17, wherein the conveying step further comprises coupling the first section to a first optical connector above the hanger.

19. The method of claim 18, wherein the conveying step further comprises connecting the first optical connector to a second optical connector attached to the second assembly, and wherein the transmitting step further comprises transmitting light through the connected first and second optical connectors.

20. The method of claim 11, wherein the conveying step further comprises:

coupling the first section to first and second optical connectors attached to the first assembly;

connecting the first optical connector to a third optical connector attached to the second assembly; and then connecting the second optical connector to a fourth optical connector in the well.

21. The method of claim 20, wherein the transmitting step further comprises transmitting light through the connected first and third optical connectors, and transmitting light through the connected second and fourth optical connectors.

22. The method of claim 20, further comprising the steps of coupling a second optical fiber section to the fourth optical connector, and positioning the second section in the well prior to the first section conveying step.

23. The method of claim 22, wherein the second section positioning step further comprises positioning the second section in a portion of the well intersecting a zone.

24. The method of claim 23, further comprising the step of measuring a temperature in the portion of the well intersecting the zone by transmitting light through the connected first and third optical connectors, through the first section, through the connected second and fourth optical connectors, and through the second section.

25. The method of claim 23, further comprising the step of gravel packing the portion of the well.

26. The method of claim 25, further comprising the step of monitoring a light transmission quality of the second section during the gravel packing step.

27. The method of claim 25, further comprising the step of monitoring a light transmission quality of the second section after the gravel packing step.

28. The method of claim 11, further comprising the step of connecting a tree to a subsea wellhead of the well after the monitoring step.

29. A method of gravel packing a wellbore of a well, the method comprising the steps of:

positioning a completion assembly in the wellbore, the completion assembly including an optical fiber section proximate a screen;

then gravel packing the wellbore proximate the screen; and monitoring an optical transmission quality of the optical fiber section during the positioning step.

30. The method of claim 29, wherein the monitoring step is performed during the gravel packing step.

31. The method of claim 29, wherein the monitoring step is performed after the gravel packing step.

32. The method of claim 29, wherein the optical fiber section is positioned within the completion assembly.

33. The method of claim 32, wherein the optical fiber section is positioned within the screen of the completion assembly.

34. The method of claim 29, wherein the optical fiber section is positioned external to the completion assembly.

35. The method of claim 34, wherein the optical fiber section is positioned external to the screen of the completion assembly.

* * * * *